United States Patent [19]

Sharp

[11] Patent Number: 4,479,678

[45] Date of Patent: Oct. 30, 1984

[54] PNEUMATIC VALVE

[76] Inventor: Robert M. Sharp, 4358 W. 8th Ave., Vancouver, B.C., Canada, V6R 2A1

[21] Appl. No.: 286,421

[22] Filed: Jul. 24, 1981

[51] Int. Cl.[3] ..... F15B 13/042

[52] U.S. Cl. ..... 297/71; 91/454; 91/461; 91/170 R; 137/596.15; 251/63.4

[58] Field of Search ..... 91/454, 170; 137/596.15; 251/63.4; 297/71

[56] References Cited

U.S. PATENT DOCUMENTS

| | | | |
|---|---|---|---|
| 2,569,881 | 10/1951 | Davies | 91/454 |
| 3,368,845 | 2/1968 | Watanabe | 297/71 |
| 3,760,843 | 9/1973 | Larner | 137/596.15 |

FOREIGN PATENT DOCUMENTS

| | | | |
|---|---|---|---|
| 2232664 | 1/1974 | Fed. Rep. of Germany | 91/454 |
| 2609340 | 9/1977 | Fed. Rep. of Germany | 91/454 |

*Primary Examiner*—Paul E. Maslousky

*Attorney, Agent, or Firm*—Rogers, Bereskin and Parr

[57] ABSTRACT

A pneumatic valve is disclosed, for controlling the position of a ram in a partly-extended condition. The valve has a combination of rubbing seals and diaphragms, for smooth operation and reliability. A spring-loaded plunger presses the diaphragm against the mouth of a port, to seal off the port. A piston with rubbing seals lifts the plunger from the diaphragm, to open the port. The piston seals rub against plastic, for freedom from water contamination problems, while the diaphragm provides the high integrity seal needed to control the ram position. A particular application of the valve is to the air control of dentist's chair, medical table or medical chair.

11 Claims, 5 Drawing Figures

PNEUMATIC VALVE

This invention relates to pneumatic control devices.

A hydraulic ram system has the ready capability that the position of the ram piston is easily controlled whether the ram is at an extremity of its travel or is only partly extended. Similarly, the position of a mechanical screw-jacking system is easily controlled whatever the state of extension of the system. In a pneumatic system on the other hand, controlling the position of a ram piston with respect to its cylinder is much more difficult. It is the common practice to confine the use of pneumatics to those systems where the ram is not required to stop at a partly extended condition, but shuttles between the fully extended and the fully retracted conditions. However, pneumatic position-control systems do exist, particularly in such applications as dentist's chairs, where the presence of other dental equipment dictates the presence of an air compressor, and where the loads and speeds of travel and the accuracy required make air the most economical medium, or where there is an explosion or shock hazard. They are also used in medical tables and chairs.

It is required in this case that when the dentist's chair has been moved to the working position, it should remain in that position without sinking, for prolonged periods. Poor maintenance, resulting in the loss of lubricant from the air supply, and especially the presence of water contamination in the air supply, means that such sinking is a not uncommon fault.

The rubber seals in pneumatic valves have had to rub over surfaces when the valves are operated. This action tends to abrade the seal unless the rubbing contact area is lubricated. If no lubricant is present, or if it is contaminated with water or has been washed out, the rubbing surface of the seal starts to break up, and sealing integrity is lost. If the surface against which the seal rubs is metal, a lump of the seal may be torn out when the seal is forced to move. If the surface is plastic, problems of the seal adhering are virtually non-existent but now the plastic material sometimes contains voids or pores that again allow sealing integrity to be lost. The storage of pressure in a ram, to hold the ram steady indefinitely in a partly extended condition, calls for the utmost sealing integrity.

It is an object of the invention to provide a pneumatic valve in which the required degree of seal integrity can be achieved in a simple, cheap manner, and can remain largely unaffected by contaminants in the supplied air. The invention is based on the premise that the seals that have to move to alter the valve setting should not be exposed to the static pressure that needs to be held in the ram. Thus the moving seals, because they only operate intermittently, can rub against plastic surfaces, where the presence of contaminants does not matter, and the static seals for the ram need now only flex to open and close.

The constructional feature of the valve of the invention is that a spring-loaded plunger presses a portion of a diaphragm against the mouth of a port, to close off the port. To open the port, a piston lifts the plunger clear, allowing air to emerge from, or enter into the port. From the port, the air is directed to or from the ram, still on the side of the diaphragm remote from the piston. Thus, any loss of integrity of the piston seals does not affect the integrity of sealing of the port.

The invention will now be further described by way of example with reference to the accompanying drawings in which.

Figure 1:
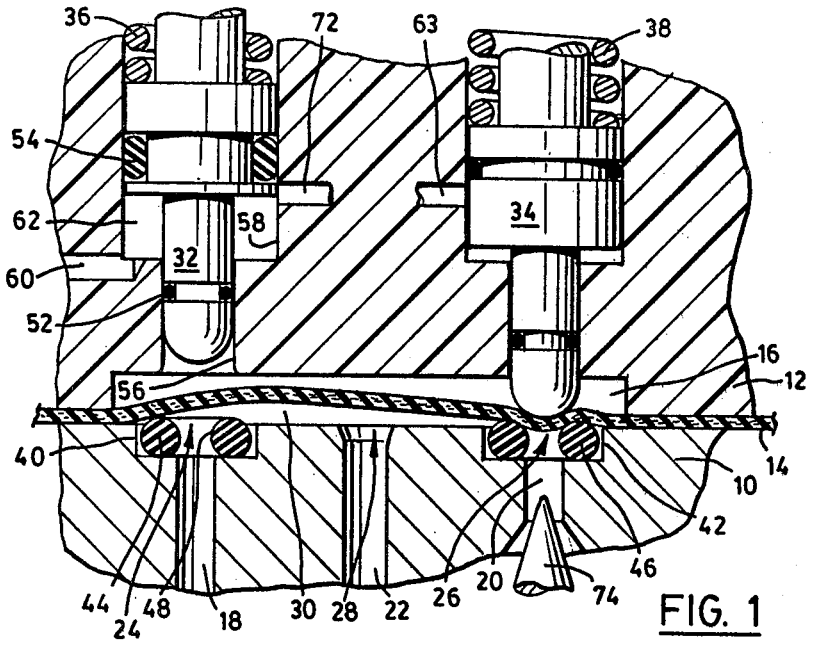
FIG. 1 is a partial cross-section of a pair of valves which embody the invention.

FIG. 1 shows a body 10 made of brass, which is bolted to an acetal resin housing 12, a fabric reinforced neoprene diaphragm 14 being clamped between the two. A recess 16 is formed in the housing 12, and the diaphragm is thus relieved of the clamp between the body 10 and the housing 12 in the area of this recess, and is free to flex.

Three ports are formed in the body 10: an inlet port 18, an exhaust port 20, and a ram port 22. Each of these ports has a respective mouth 24, 26, 28 which opens into a common chamber 30 which exists between the diaphragm and the body 10 when the diaphragm is flexed, at least partly, away from the body 10 into the recess 16. The chamber 30 is not connected to any ports other than the said three.

Positioned in the housing 12, on the far side of the diaphragm 14, are an inlet plunger 32 and an exhaust plunger 34, in line respectively with the inlet port 18 and the exhaust port 20. The plungers 32, 34 are urged by respective springs 36, 38 towards the mouths 24, 26 of the ports 18, 20.

The inlet and exhaust ports 18, 20 are counterbored each at their mouths 24, 26 and into the respective counterbores 40, 42 are placed rubber O-rings or other resilient seals 44, 46. The O-rings form soft, resilient seatings 48, 50 against which the diaphragm 14 is pressed by the action of the springs 36, 38 on the plungers 32, 34. The plungers 32, 34 have hemispherical ends to urge the diaphragm into intimate contact with the O-rings, to seal off the ports 18, 20. Other suitably shaped ends may also be used, e.g. chamfered ends, to avoid damaging the diaphragm.

Each plunger 32, 34 includes a small diameter portion that provides a plunger member, and a large diameter portion that serves as a piston member, the large diameter piston also defining a sealed area connected to a pilot port. The inlet plunger 32 has two rubber seals 52, 54 which rub against the bores 56, 58 of the housing 12 when the plunger moves in the housing. When air is admitted through the pilot port 60 to the annular area 62, the plunger 32 moves upwards, allowing the diaphragm 14 to flex away from the seating 48 and to open the mouth 24 of the port 18 to the chamber 30. Air pressure in the port 18 can therefore flow into the ram port 22. If the pilot port 60 is exhausted, the plunger 32 descends, and seals off the port 18.

The exhaust plunger 34 works in a corresponding manner when air is admitted through its pilot port 63, to allow pressure in the ram port 22 to escape through the exhaust port 20.

Figure 2:
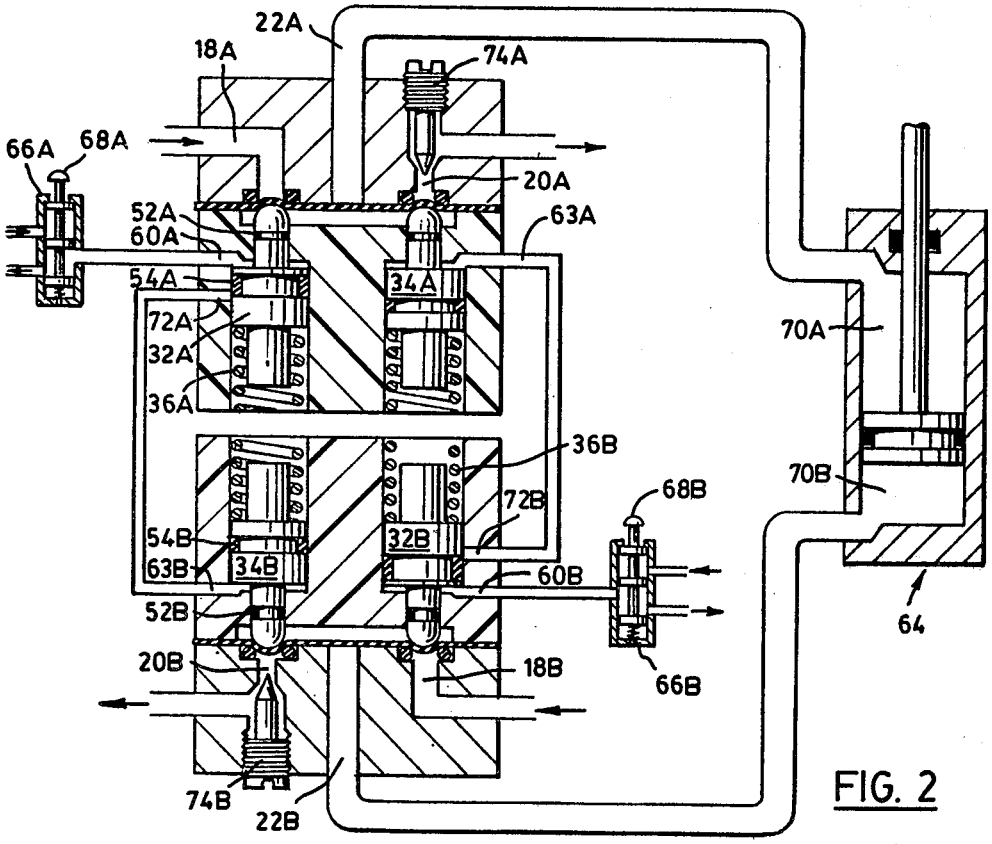
FIG. 2 is circuit diagram including a pneumatic ram, and a pneumatic control device in partial cross-section.

Two pairs of valves are shown in FIG. 2, connected to form a control device for a pneumatic ram 64. (The four valves are actually arranged side by side, at the four corners of a square, in a common body and a common housing. FIG. 2 includes sections through both pairs of valves, one section being inverted to illustrate the symmetry of the connections.) The pilot port 60A, 60B for each inlet plunger 32A, 32B is externally connected to a respective conventional three-port valve 66A, 66B. As shown in FIG. 2, when the buttons 68 of the valves 66 are at rest, the ports 60 are open to exhaust, and the plungers 32 close off the ports 18 under the action of the springs 36.

Similarly, there is no pressure in the supply ports 63A, 63B to the exhaust plungers 34A, 34B so that the exhaust ports 20A, 20B are also closed off. Therefore, whatever air pressure is present in the ram ports 22A, 22B, and in the respective sides 70A, 70B of the ram 64 will remain, and will remain indefinitely providing there are no leaks. It is recognized in the invention that the urging of the diaphragm onto the seatings by the spring loaded plungers provides an extremely reliable seal, capable of operating for extended periods whatever the content of water or other contaminants in the pressurised air.

The plungers 32, 34 of course are sealed not by diaphragms but by rubbing seals, which do tend to deteriorate, especially if the air is contaminated. Thus, a pressure in the line 60A for example could not be held indefinitely but would gradually leak past the seals 52, 54, after those seals have had a period of service. Also, the air can leak through pores in the plastic material of the housing 12; it is very expensive to inspect the housings to reject those that contain pores. However, these common difficulties of contaminated-air systems are confined to the pilot air circuit, and do not affect the ram air circuit. The pilot air is only switched on for a short time while the ram is actually moving, so that leaks in the pilot system are barely noticeable, and do not lead to a loss of performance. Also, because the seals rub against plastic, even water can act as a lubricant, to prevent adhering of the seal to the bore. Thus, the valve and control device of the invention need much reduced maintenance, and the chance of unexpected failure is much reduced.

To operate the ram 64 upwards, one presses the button 68B (for example). This admits air to the port 60B which blows the plunger 32B upwards against the spring 36B, thus allowing the inlet port 18B to connect with the ram port 22B via the chamber 30B, and hence to pressurise the side 70B of the ram 64. When the plunger 32B has risen through sufficient distance for it to be certain that the port 18B is open, the seal 54B on the plunger sweeps over a further port 72B in the wall of the bore 58, exposing the port 72B to the air pressure in the annular area 62B. The port 72B is connected to the pilot port 63A of the exhaust plunger 34A, so that the plunger 34A is now blown against its spring 38A, to open the port 20A. Thus any pressure in the chamber 30A due to pressure in the side 70A of the ram 64 can escape down the exhaust port 20A. Thus it is ensured that the pressure which is to move the ram is built up before the pressure against which the ram is to move is released, which makes for a smooth, controlled movement of the ram, free from jerks. To release the air from the port 63A, the valve 32B must first descend, to expose the port 72B to the atmosphere.

Each exhaust port 20A, 20B is provided with an adjusting screw 74A, 74B by which the speed of escape of the air from the corresponding side of the ram can be controlled, thus to control the speed of the ram itself.

The particular field of applicability of the invention is that of dentists' and medical chairs and medical tables. Not only is smooth, jerk-free operation desirable, but desirable also is reliability of operation even when the air pressure supply equipment is ill-maintained, or ill-suited to the task.

The strength of the springs 36, 38 may be such as to ensure that the plungers will only rise if the pilot air pressure is above a certain minimum. If the supply pressure drops, the valves will not open, which is an important safety feature in medical and dental applications.

Figure 3:
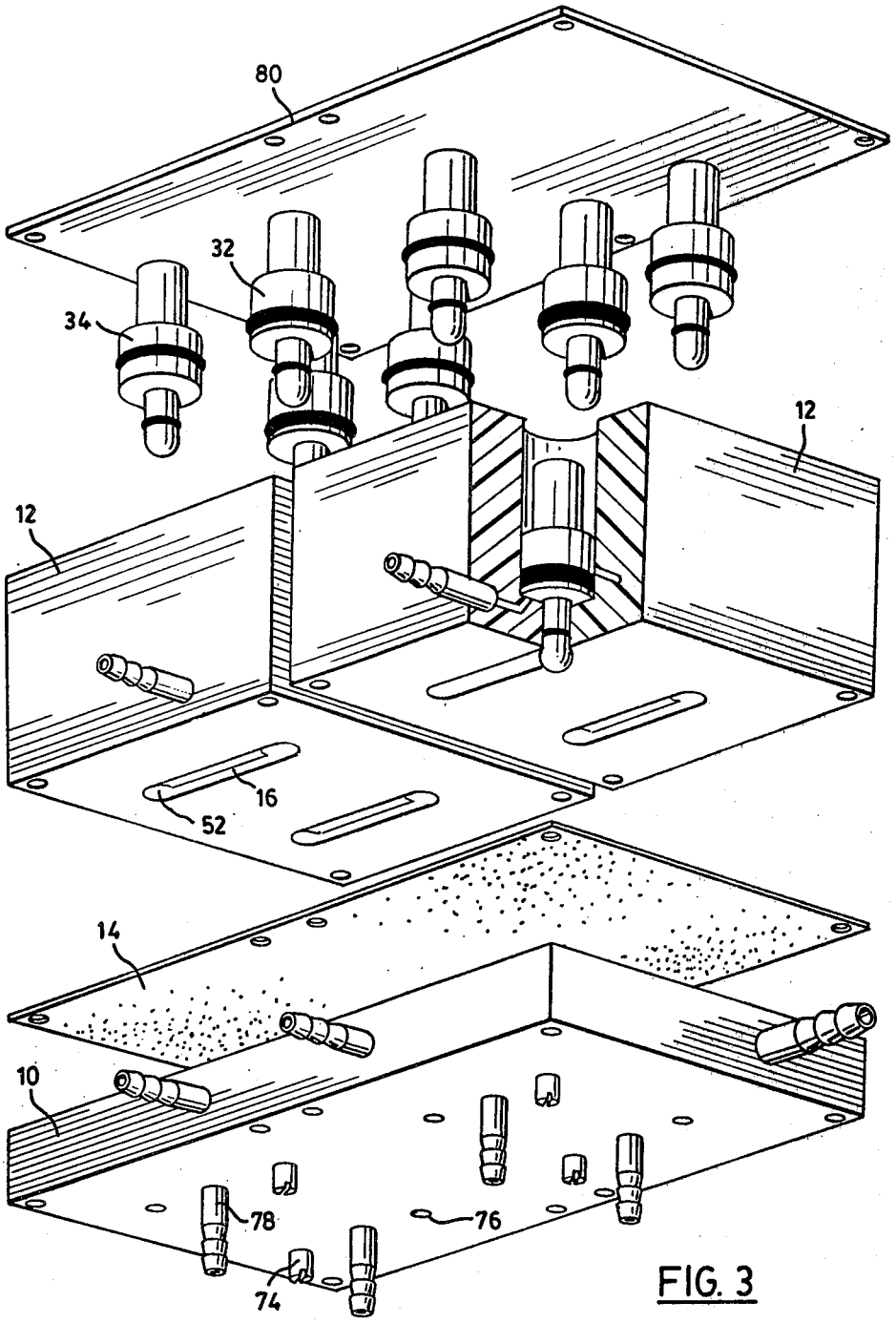
FIG. 3 is an exploded perspective view of a double valve unit.

In FIG. 3, a practical construction of a double valve unit is illustrated. The unit includes two plastic housings 12, each containing two pairs of plungers (i.e. eight plungers in all); two pairs each for the two cylinders (or sets of cylinders) used on the seat and the back of a dentist's chair. Each housing 12 is secured to a unitary brass body 10 by bolts (not shown) at the four corners.

The body 10 is provided with cross drillings to form the various inlet, exhaust, and ram ports, the drillings being closed by plugs, as at 76 for instance, where appropriate. Studs 78 are provided for the easy attachment of plastic tubing to the various ports. A cover 80 is bolted over the housings 12, to hold down the springs 36, 38 (not shown in FIG. 3).

The valve unit illustrated is reliable in use, and simple and cheap to construct. It may be made in double, triple or even more units depending on the application.

It may be noted that the valve normally controls and positions a ram by maintaining pressure on both sides of the ram at all times, and it allows movement of the ram by allowing a pressure differential to develop between the two sides and by controlling such pressure differential.

Figure 4:
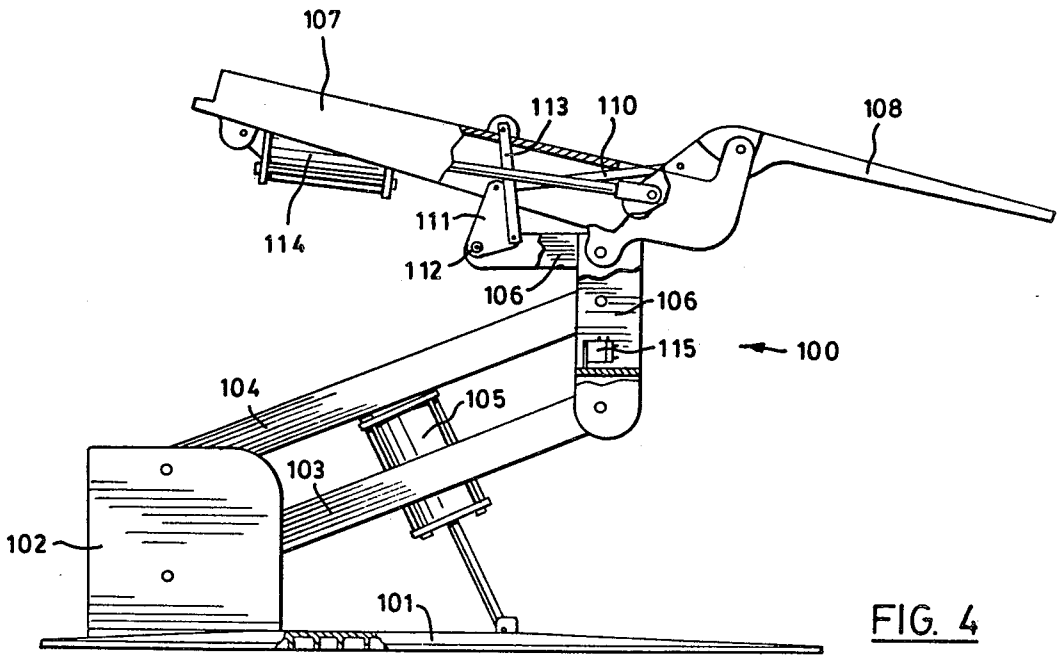
FIG. 4 is a diagrammatic view of a dental or medical chair for use with a valve of the invention.

FIG. 4 shows diagrammatically a typical dental or medical chair 100 incorporating a control pneumatic valve according to the invention. The chair 100 is itself conventional and includes a base 101, a housing base or front "U" 102, and parallel support arms 103, 104 pivotally connected to the base 102. The arms 103, 104 are raised and lowered by a ram 105 and are pivotally connected to a seat lower frame 106. Pivotally connected to the frame 106 is a seat frame 107, with a back 108 being pivotally connected at 109 to the frame 107. A connecting rod 110 extends between the back 108 and a bell crank 111 which in turn is pivotally connected at 112 to the frame 106. A raise rod 113 is also pivotally connected between the bell crank 111 and the frame 107. Finally, a ram 114 is connected between the frame 107 and the back 108.

The chair 100 is controlled by a dual pneumatic valve 115 of the kind previously described and illustrated. Valve 115 controls the rams 105, 114, which respectively control the height of the chair and the inclinations of the frame 107 and back 108.

Figure 5:
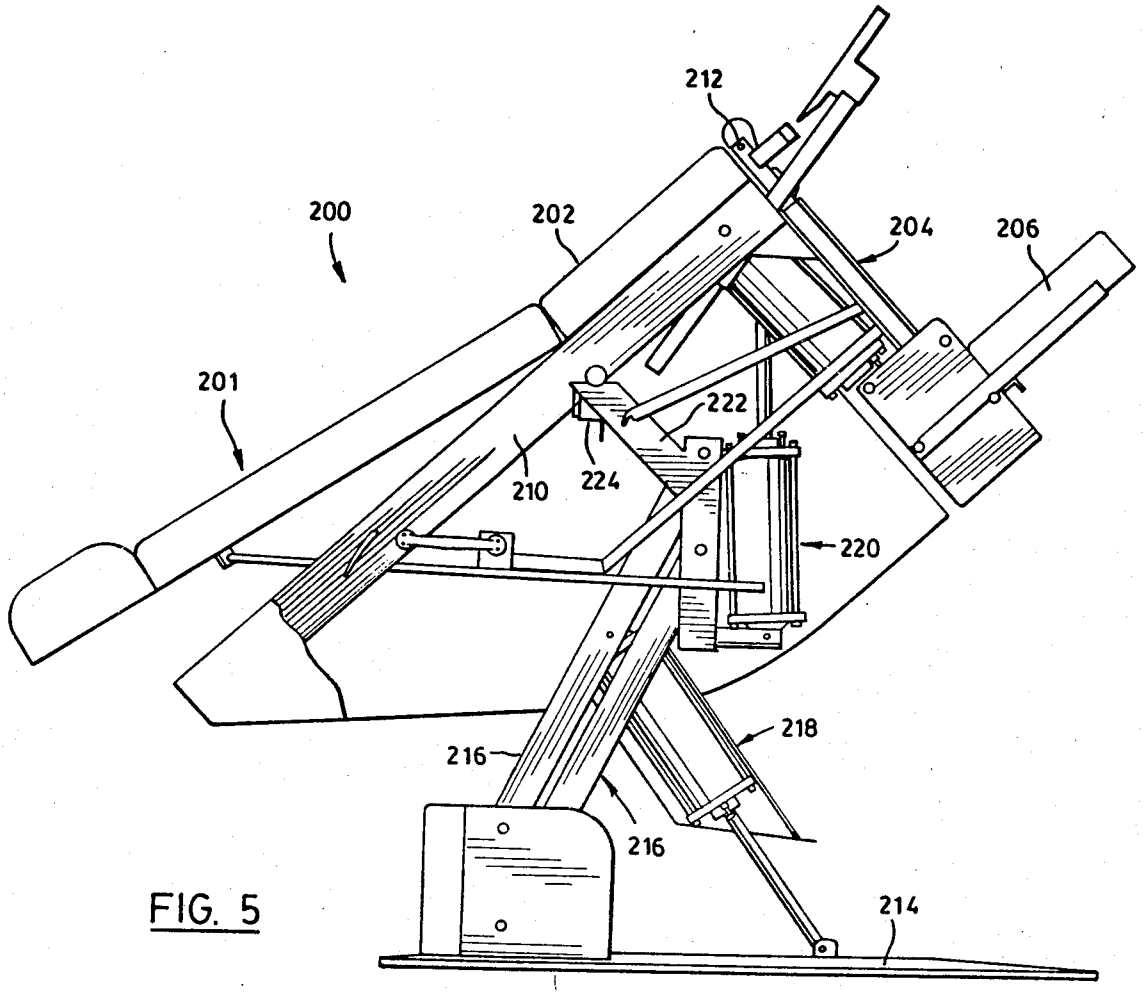
FIG. 5 is a diagrammatic view of a medical table for use with a valve of the invention.

FIG. 5 shows diagrammatically a medical table 200 incorporating a control pneumatic valve according to the invention. Again the table 200 is conventional and includes a bed board 201, a bed board extension 202, a vertical pad 204 and a knee board 206. The bed board 200 is pivotally connected at 208 to a frame 210. The bed board extension 202 is fixed to the frame 210. The vertical pad 204 is pivoted at 212 to the frame 210 and the knee board 206 is removably fixed to the bottom of the vertical pad structure.

Like the dental chair, the entire structure is mounted on a base 214 by parallel arms 216 powered by a ram 218. In addition the inclination of the frame 210 is controlled by another ram 220. Ram 220 is connected to a tilting frame 222. Frame 222 is in turn connected to the free ends of arms 216 and pivotally supports frame 210. The piston rod of ram 220 is connected to the frame 210 to control the tilt of the table. The rams 218, 220 are again controlled by a pneumatic valve 224 of the kind previously described and illustrated.

What I claim is:

1. A pneumatic valve comprising: a body which is made of metal, and which defines a port, which includes a mouth in a surface of the body, the mouth of the port being formed as a valve seating; a diaphragm which is made of elastomeric material, and is placed so as to lie over the valve seating and adjacent the surface of the body; a plunger member which is moveably mounted adjacent to the diaphragm; a spring acting on the plunger member so that the plunger presses the diaphragm onto the valve seating, thereby sealing off the mouth of the port; a housing member defining a bore, with a part of the housing member against which a seal rubs being formed of a plastic; a piston member, for actuating the plunger member, which piston member is slidably mounted in the bore of the housing member; and a seal made of an elastomeric material and located between the piston member and the bore of the housing; whereby, in use, when air pressure acts on the piston member, the piston member urges the plunger member, against the action of the spring, to a position where the plunger member no longer presses the diaphragm on to the valve seating, thereby opening the mouth of the port.

2. A valve as claimed in claim 1, wherein the plunger member and the piston member are integral with one another.

3. A valve as claimed in claim 1, wherein the material of the diaphragm is in sheet form, which is trapped between the surface of the body and the housing member and acts as a seal therebetween.

4. A valve as claimed in claim 2, wherein the valve seating is formed by an elastomeric seal located with respect to the body in a counterbore to the port, the plunger member being formed with an end for contact with the diaphragm, said end having a tapered edge.

5. A valve as claimed in claim 1, wherein the body is made of brass; the piston member, plunger member, and housing member are formed of a plastics material; and the diaphragm, seal, and valve seating of an elastomeric material.

6. A pneumatic control device having a pair of valves each as claimed in claim 1, wherein both the mouths of the ports open into a common chamber, and the valves act one to admit a supply of air pressure to the chamber, and the other to exhaust air from the chamber, when the respective valves are open.

7. A pneumatic control device having two pairs of valves, each pair as claimed in claim 6, the two chambers being connected respectively one to each side of a pneumatic ram.

8. A device as claimed in claim 7, wherein the two valves that act to exhaust the air from the respective sides of the ram are actuated by air received from ports that are opened only after the two valves that act to admit the air to the respective sides have opened.

9. A device as claimed in claim 7, wherein each exhaust valve is provided with an adjustable restrictor, whereby the speed can be controlled of air exhausting through the valve from each respective side of the ram.

10. A dentist or medical chair, having an adjustable base and an adjustable seat back, respective pneumatic rams acting to control the position of the base elevation and seat back, the air to the sides of each ram being controlled by means of a device as claimed in claim 7.

11. A medical table having an adjustable base and an adjustable table surface, respective pneumatic rams acting to control the position of the base elevation and table surface, the air to the sides of each ram being controlled by means of a device as claimed in claim 7.

* * * * *